US005423099A

United States Patent [19]

Gulli

[11] Patent Number: 5,423,099

[45] Date of Patent: Jun. 13, 1995

[54] INFANT SAFETY PILLOW

[76] Inventor: Frank Gulli, 62 Livingston Ave., Dobbs Ferry, N.Y. 10552

[21] Appl. No.: 178,064

[22] Filed: Jan. 6, 1994

[51] Int. Cl.[6] ..... A47G 9/00

[52] U.S. Cl. ..... 5/638; 5/468

[58] Field of Search ..... 5/638, 636, 655, 468, 5/93.1, 630, 632, 461, 643

[56] References Cited

U.S. PATENT DOCUMENTS

| | | | |
|---|---|---|---|
| 1,970,754 | 8/1934 | Jonasen | 5/484 |
| 2,570,736 | 10/1951 | West | 5/900.5 |
| 2,695,415 | 11/1954 | Holton | 5/638 |
| 2,807,033 | 2/1956 | Austen | 5/461 |
| 2,846,700 | 8/1958 | De Puy | 5/655 |
| 3,042,938 | 7/1962 | Lawson | 5/638 |
| 3,089,153 | 5/1963 | Bosc | 5/655 |
| 3,209,380 | 10/1965 | Watsky | 5/461 |
| 3,339,216 | 9/1967 | Omerod | 5/461 |
| 3,633,222 | 1/1972 | Greenfield | 297/452.14 |
| 3,656,193 | 4/1972 | Schneider et al. | 5/655 |
| 4,234,977 | 11/1980 | Snow | 5/655 |
| 4,335,476 | 6/1982 | Watkin | 5/464 |

FOREIGN PATENT DOCUMENTS

| | | | |
|---|---|---|---|
| 2225229 | 5/1990 | United Kingdom | A47C 27/15 |

*Primary Examiner*—Alexander Grosz

*Attorney, Agent, or Firm*—Martin J. Spellman, Jr.

[57] ABSTRACT

An infant safety pillow of molded plastic with side walls, and a rear wall molded integrally with a gently inclined central perforated surface joined to the walls by a rolled shoulder. The base of the wall have spaced openings in their lower edges. A sponge rubber strip runs between the left and right side walls along the lower face of the front edge of the perforate surface.

2 Claims, 5 Drawing Sheets

FIG.1
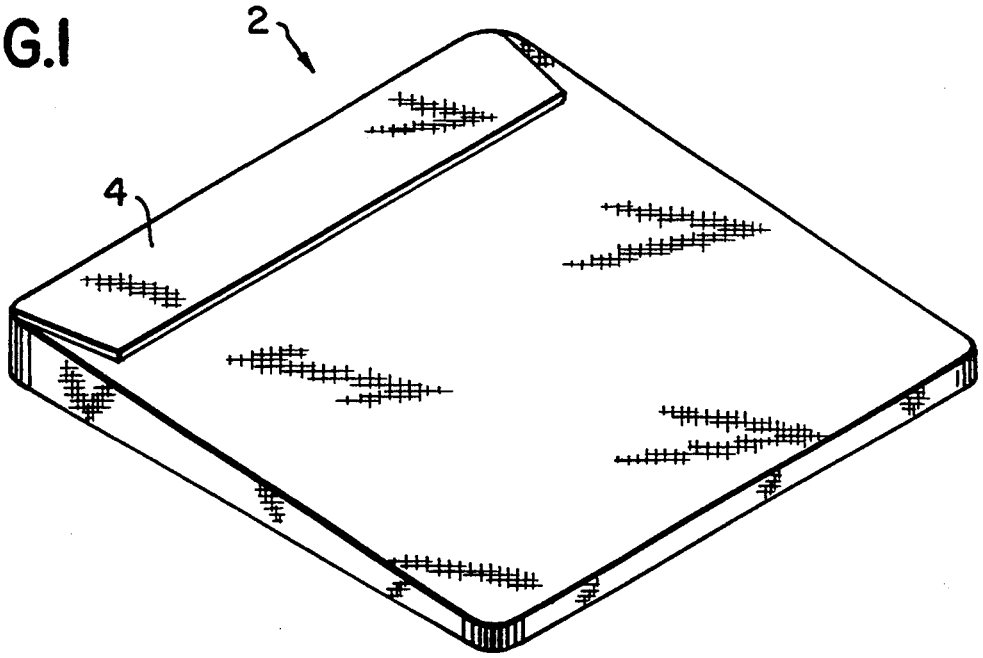
FIG.2
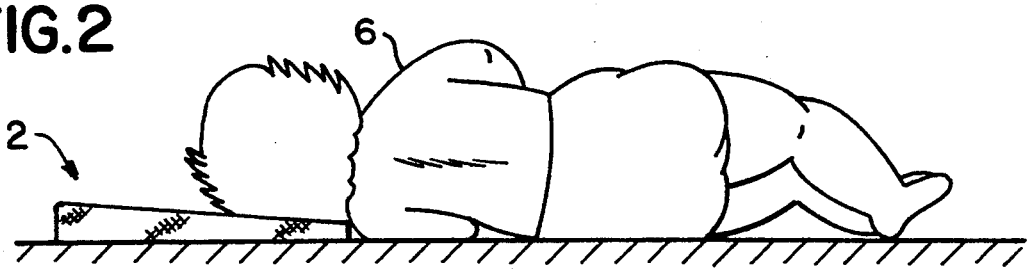
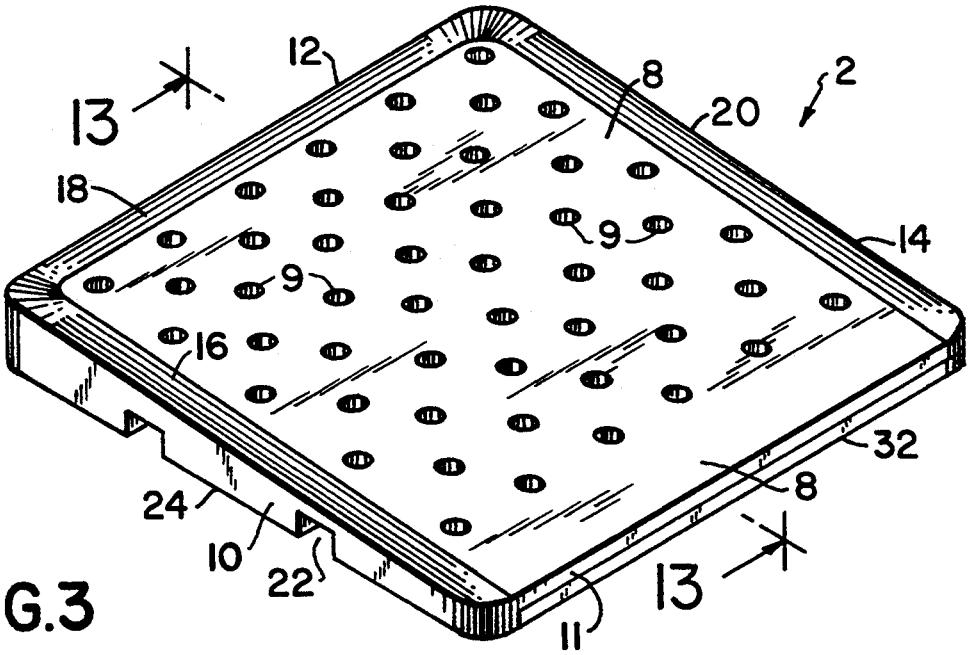
FIG.3

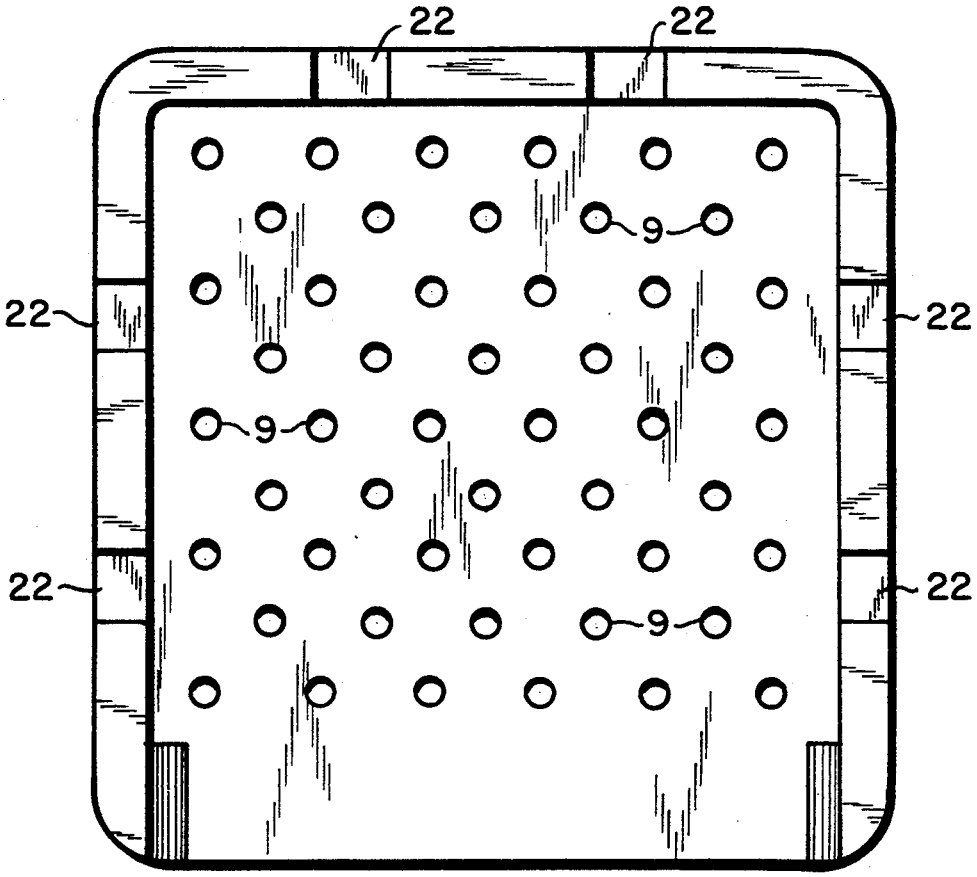
FIG.6
FIG.7
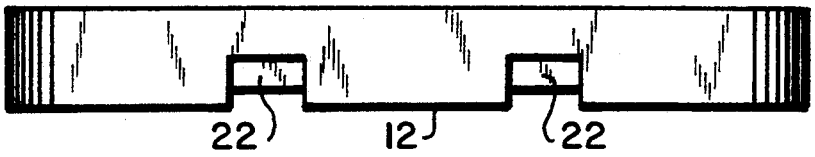
FIG.8
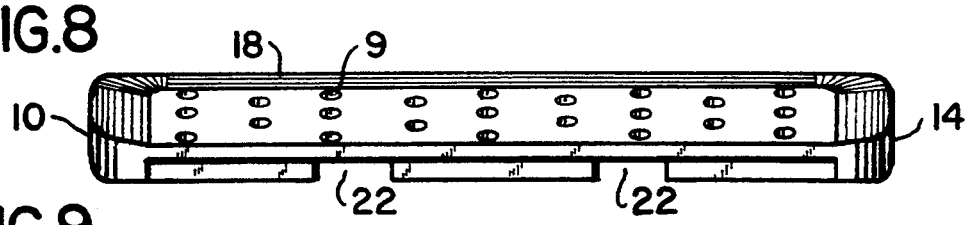
FIG.9
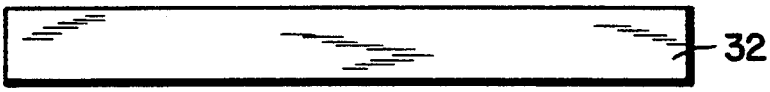
FIG.10
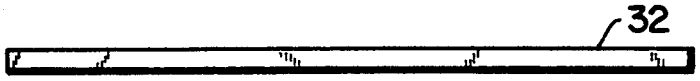

INFANT SAFETY PILLOW

BACKGROUND OF THE INVENTION

1. Field of the Invention

This field leads to pillows and particularly to pillows for utilization by infants especially when sleeping in the crib. Particularly, this invention is concerned with an infant pillow that is comfortable and easily kept clean and minimized the possibility of the infant not being able to breathe when laying on its stomach with its face, in particularly nose and mouth, pressed against the pillow.

2. Prior Art

Efforts have been made in the construction of mattresses for infants and invalids in order to minimize the possibility of the person's body overheating and the person, particularly an infant, inadvertently suffocating when laying on its stomach with the mouth and nose pressed against the usual imperforate mattress with fine pore coverings.

In U.S. Pat. No. 3,339,216, Ormerod, discloses a mattress with a resilient plastic pad with large air holes for the head supporting part and a textile sleeve covering the head supporting part and a plastic sleeve covering the remainder of the pad. Perforations are in the order of a half inch in diameter. This requires special mattress structure which is not readily transportable.

In U.S. Pat. No. 2,695,415, Holton, having good head supporting sections pair of metal tubular supports and parallel spaced relationship, thin supporting head rest extending there between is disclosed. This is comprised as a whole mattress structure. The mattress structure is resilient plastic pad with large air holes and head supporting part.

U.S. Pat. No. 2,570,736, West discloses a mattress structure with air circulating passages connected with air slots at the head to facilitate breathing and other spaces at the base of the mattress for the feet.

U.S. Pat. No. 2,807,033, Austen discloses another mattress having air connected passages with optionally insertable plugs to plug certain holes in the top surface while allowing horizontal circulation in the structure.

U.S. Pat. No. 3,042,938, Lawson discloses a pillow structure to allow free flow of air in passages and to remove the secretions from the nose and mouth. It is comprised of various structures of honey comb material.

U.S. Pat. No. 3,209,380, Watsky discloses a rigid mattress structure to provide support for a person with back problems. The structure is provided with a variety of air passages to maintain the comfort of the user circulating the air to keep the mattress fresh and to prevent overheating. There isn's any suggestion of breathing advantages.

U.S. Pat. No. 4,335,476, Watkin discloses a mattress having differentially firm and soft areas to provide the spine with proper curvature for comfort and orthopaedic purposes. This variation in softness and support in different areas is achieved by the varying density in the concentration of apertures of structure of the mattress material. The apertures also serve for circulation purposes, but there is no suggestion of enhanced breathing qualities.

A variation on mattress structures for circulation is disclosed in British Patent 2,225,229 A.

As will be noticed most of the structures are directed towards various ventilated mattress structures which are not portable and are very elaborate in sense of structures.

SUMMARY OF THE INVENTION

The present invention provides a safe portable infant pillow with a slightly inclined surface. The perimeter on three sides is slightly raised in a rounded structure to maintain the infant's head within the desired surface area. A slightly slanted central area is provided with spaced apart perforations in the form of circular apertures or slots to allow circulation of air from underneath the raised support surface of the pillow. One end of the platform facing the infant is provided with a flexible sponge strip to allow flexibility of the support device. Optionally the device structure may be covered with a pillow case envelope which may be changed periodically for sanitary reasons. The present structure is light, flexible, comfortable and readily washed and transported to different beds or other sleeping surfaces which may be utilized. It is constructed from light plastic material and is dimensioned so as to give a reasonable degree of flexibility for comfort. The device of the present invention is constructed so as to urge the infant's head to maintain its position on the device.

In accordance with the present invention, a unique safety pillow for infants is provided which is convenient to use, readily transportable for use in different beds or other sleeping surfaces. It comfortably positions the infant's head in the proper position and assures the infant access to a source of fresh flowing air even when asleep on its stomach. The safety pillow of the present invention is comprised of a central inclined surface about one foot by one foot rising from a low front edge to a slightly raised back edge with tapered side walls. The sides and back edge rise slightly above the main support surface and are rolled down to gently join the surface to urge the infant towards the center of the surface, and yet maintain comfort.

The left and right side and the back side are provided with openings in their lower edges to allow a flow of air under the supporting surface from either side of the device and from the rear wall side also. The lower surface of the device at the front edge is provided with soft sponge rubber strip that gently supports the front edge against the surface of the bed or other surface on which the pillow is utilized.

One advantage of the present pillow is that aside from assuring comfortable surface for the infant's head to lie on and providing assured flow of air to the infant's mouth and nose it is readily transportable between different cribs and can be utilized on any surface on which the infant is laid down to sleep.

The central surface is provided with uniform pattern of circular apertures that are generally approximately a half inch in diameter and spaced approximately 2½ inches from each other on center. This pattern is shown most clearly in FIGS. 3–6. The main portion of the device is molded from thermoplastic such as polyethylene compounded to give a flexibility to the pillow for comfort and is generally about ⅛ inch in thickness. The lower front surface has an adhesively secured thereto a sponge rubber strip for gentle edge support of the front edge which does not have any molded wall per se in order to allow flexibility at the point of contact with the underlined mattress or other sleeping surface. For additional comfort and sanitary purposes a changeable pillow case can be used to encase the pillow.

BRIEF DESCRIPTION OF THE DRAWING

A brief description of the accompanying drawing which forms a part of this specification:

FIG. 1 is a perspective view of the device of the present invention with the pillow case cover in place;

FIG. 2 is a side view of the device showing an infant reclining thereon;

FIG. 3 is a perspective view of the device without the cover;

FIG. 6 is a bottom plan view of the device along lines 6—6 of FIG. 4;

FIG. 7 is an back end plan view of the device along lines 7—7 of FIG. 4;

FIG. 8 is a front end plan view of the device along lines 8—8 of FIG. 4;

FIG. 9 is a top plan view of the adhesively connected soft strip;

FIG. 10 is a side plan view of the strip;

ILLUSTRATIVE SPECIFIC EMBODIMENT

Figure 4:
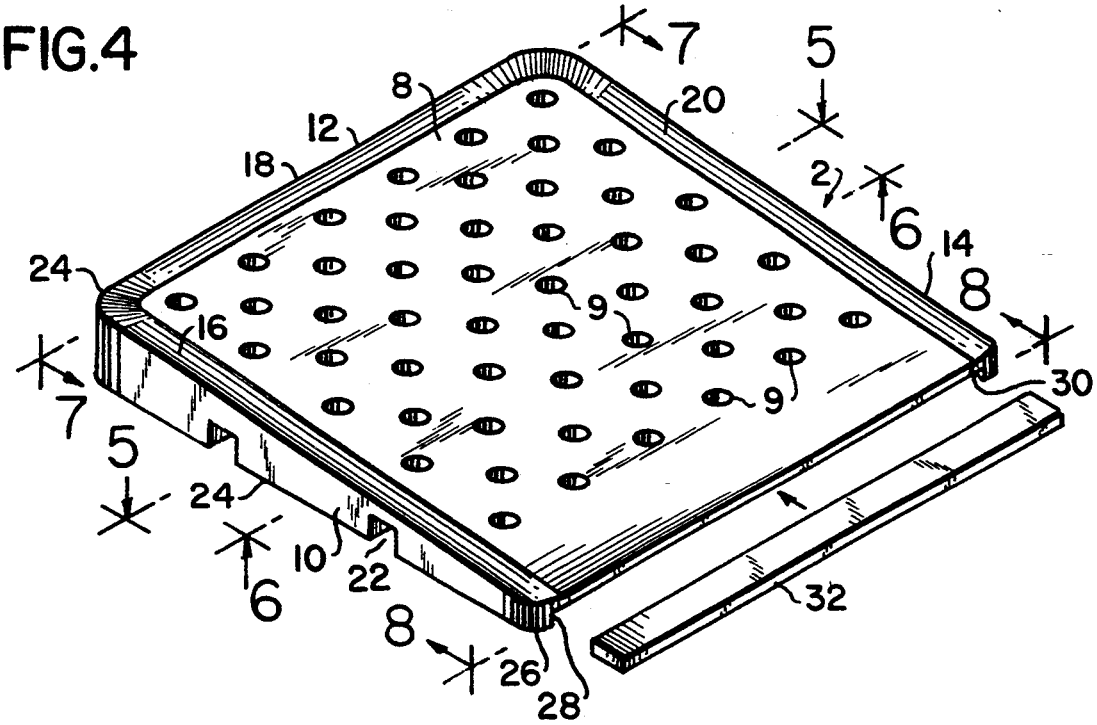
FIG. 4 is a perspective view of the device showing a soft strip.
Figure 5:
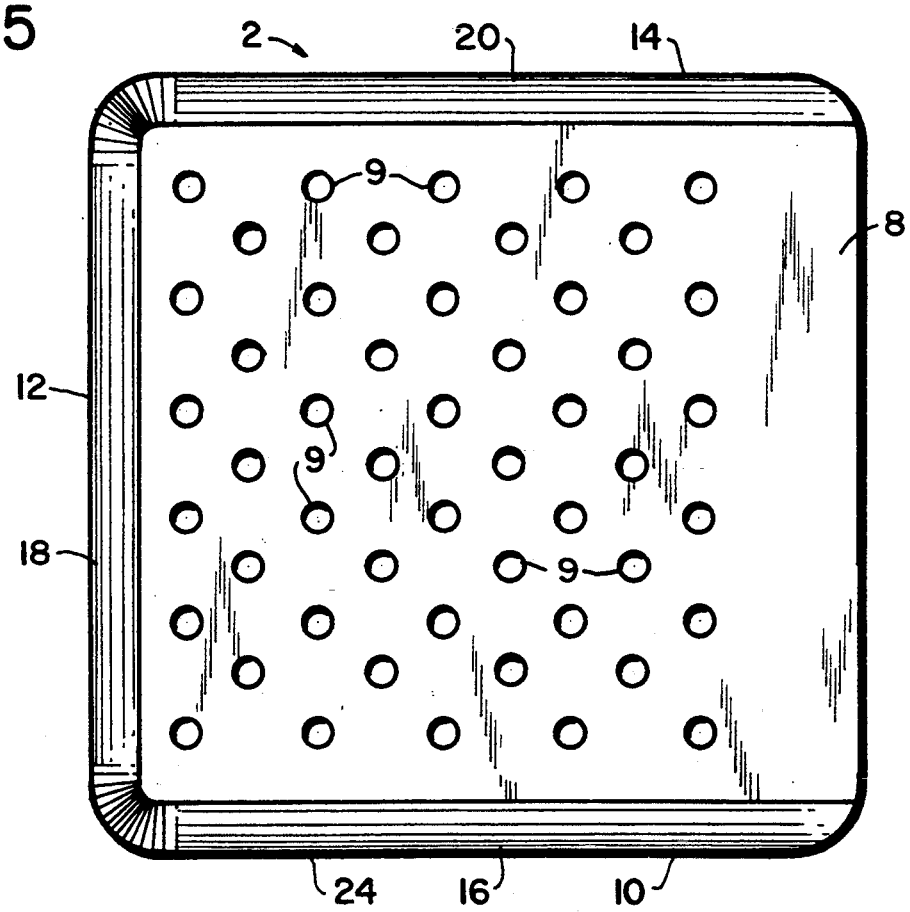
FIG. 5 is a top plan view of the device along lines 5—5 of FIG. 4.

The device of the present invention as indicated in the drawings generally by the numeral 2 and FIG. 1 is shown with the pillow case or cloth envelope in place. The material is thin and easily permeable to air therethrough and is included for comfort and sanitary purposes. In FIG. 2, an infant 6 is shown with its head resting on the pillows of ice 2 of the present invention.

Figure 11:
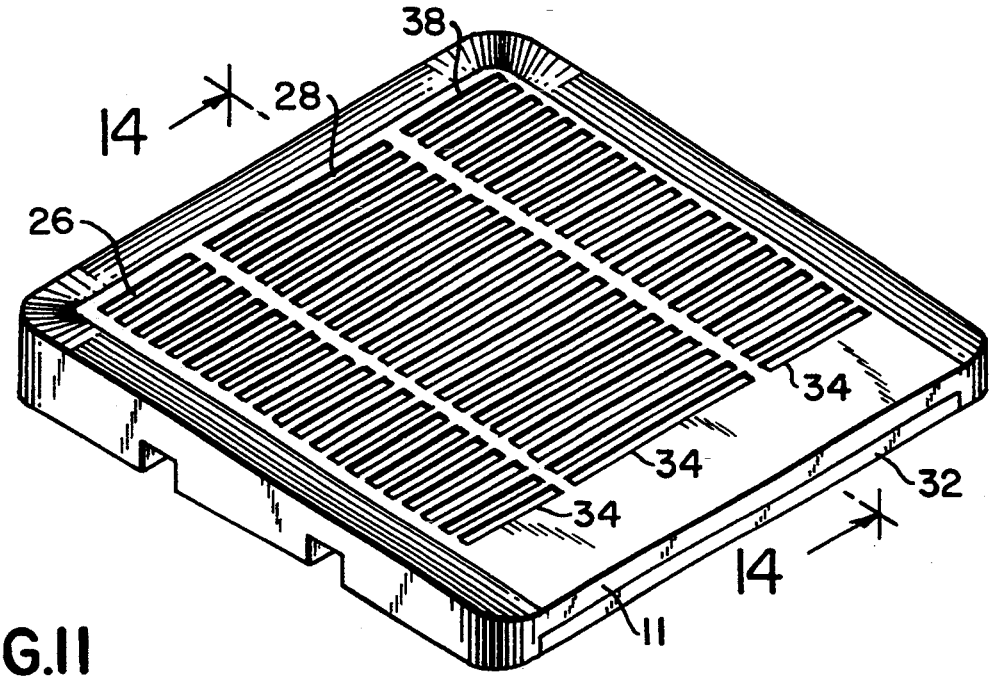
FIG. 11 is a perspective view of an alternative embodiment of the device having slot ventilating openings.
Figure 12:
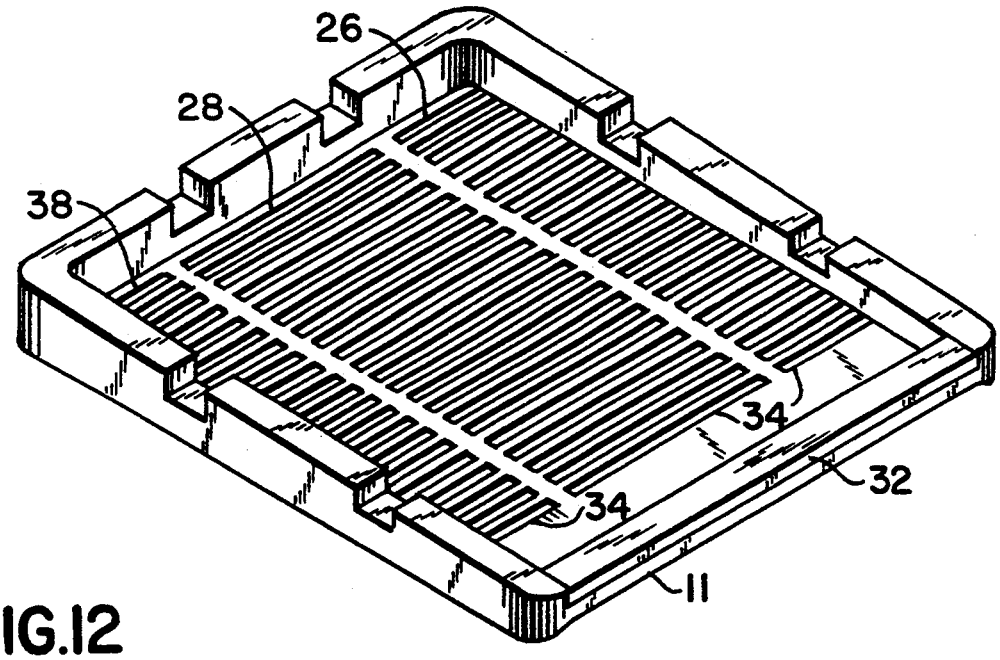
FIG. 12 is a perspective view of the underneath side of the alternative embodiment of FIG. 12.
Figure 13:
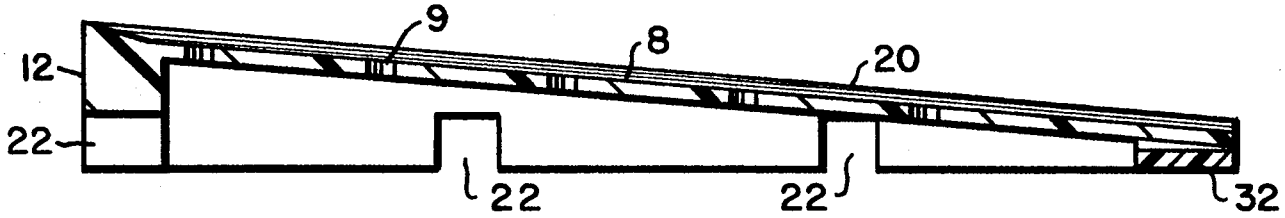
FIG. 13 is a longitudinal sectional view of the device of Figure along lines 13—13.
Figure 14:
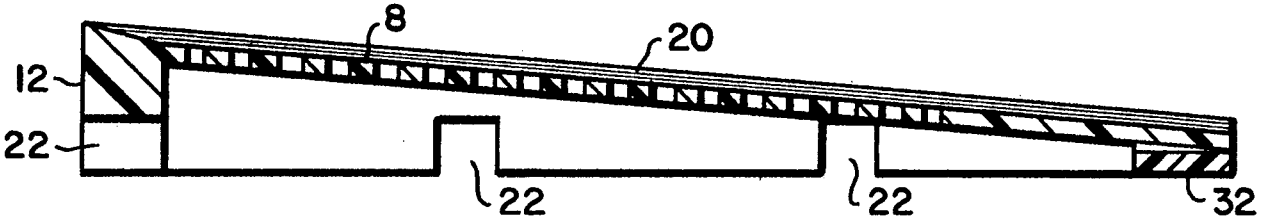
FIG. 14 is a longitudinal sectional view of the alternative embodiment of FIG. 11.

The device includes the central surface area or surface platform 8 which is an inclined gently upward from the front 11 to the rear 12. The device is of molded polyethylene plastic and has left side 10, the rear side 12 and right side 14. Each of the sides rises slightly above the height of the surface 8 and then is rolled down to gently blend with the surface. The rolled edges are indicated by numerals 16, 18 and 20 respectively in the drawing. Patterned apertures 9 of approximately ½ inch in diameter are provided in the surface 8 and are indicated by 9. Each of the sides has generally rectangular openings 22 into the lower edge 24 of the device on the respective sides to allow the free circulation of air under the surface 8 at all times. The lower front edge 28 is just slightly above the lowest portion of the sides and has a sponge rubber strip 32 adhesively secured thereto. In FIGS. 11, 12 and 14, an alternative embodiment is shown wherein the surface 8 is provided with side row 26, central row 28 and another side row 30 of slots 34 as an alternate to the circular openings or aperture 9 in the previous embodiment. The device of the present invention is manufactured of polethylene approximately ⅛ inch thick so that it provides a gentle give when the infant's head is placed thereon.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. An infant safety pillow comprising a molded plastic structure having spaced apart vertical left and right side walls, and a rear wall, said walls integral with, and rising slightly about a gently inclined central generally rectangular perforated surface, said perforate surface having rear, side, and front edges, said rear and side edges of said perforate surface being united with the top (tops) of said side and rear walls by a rolled shoulder, said walls each having spaced openings in (the) their lower edges, a sponge rubber strip running from said left side wall to said right side wall on the lower (surface) face of said perforate surface along said front edge thereof.

2. A pillow as claimed in claim 1 wherein said perforations are circular apertures approximately ½ inch in diameter.

* * * * *